US005235771A

United States Patent [19]

Sokol et al.

[11] Patent Number: 5,235,771

[45] Date of Patent: Aug. 17, 1993

[54] HAND HELD GRENADE LAUNCHER

[75] Inventors: William M. Sokol, South Windsor; David M. Camera, Meriden; Ronald E. Giddish, Windsor, all of Conn.

[73] Assignee: Colt's Manufacturing Company Inc., West Hartford, Conn.

[21] Appl. No.: 23,163

[22] Filed: Feb. 25, 1993

Related U.S. Application Data

[63] Continuation of Ser. No. 811,716, Dec. 20, 1991, abandoned.

[51] Int. Cl.[5] ..... F41C 27/06

[52] U.S. Cl. ..... 42/105; 42/75.03

[58] Field of Search ..... 42/75.01, 75.02, 75.03, 42/75.04, 71.01, 105; 89/37.05, 1.35

[56] References Cited

U.S. PATENT DOCUMENTS

| | | | |
|---|---|---|---|
| 183,993 | 10/1876 | Wallis | 42/77 |
| 1,816,265 | 7/1931 | Savani | 42/105 |
| 1,948,511 | 2/1934 | Coupland | 42/105 |
| 3,279,114 | 10/1966 | Lewis et al. | 42/105 |
| 3,507,067 | 4/1970 | Into | 42/10 |
| 3,557,482 | 1/1971 | Hoover | 42/105 |
| 3,675,534 | 7/1972 | Beretta | 89/185 |
| 3,706,151 | 12/1972 | McNeill | 42/105 |
| 3,782,021 | 1/1974 | Atchisson | 42/105 |
| 4,128,059 | 12/1978 | Black | 102/513 |
| 4,156,981 | 6/1979 | Lusk | 42/105 |
| 4,220,092 | 9/1980 | Smith et al. | 102/529 |
| 4,291,479 | 9/1981 | Lough | 42/103 |
| 4,603,498 | 8/1986 | Johnson | 42/105 |
| 4,654,993 | 4/1987 | Atchisson | 42/71.01 |
| 4,725,235 | 2/1988 | Schroeder et al. | 434/18 |
| 4,733,489 | 3/1988 | Kurak | 42/77 |
| 4,788,785 | 12/1988 | White | 42/72 |
| 5,052,144 | 10/1991 | Ostor | 42/105 |

FOREIGN PATENT DOCUMENTS

| | | | |
|---|---|---|---|
| 1944649 | 3/1971 | Fed. Rep. of Germany | 42/105 |
| 1073266 | 9/1954 | France | 42/75.04 |
| 300997 | 11/1928 | United Kingdom . | |

*Primary Examiner*—Stephen M. Johnson
*Attorney, Agent, or Firm*—Perman & Green

[57] ABSTRACT

An adapter for use with a rifle mountable grenade launcher unit to form a stand alone hand held grenade launcher. The adapter includes a rod to be inserted into a rifle barrel receiving hole of grenade launcher unit and a recoil surface that can be located, at least partially, behind the barrel bore of the grenade launcher unit. The recoil surface intersects the center axis of the grenade launcher unit barrel bore such that recoil after firing can be absorbed in line with the barrel bore to thereby minimize muzzle climb.

13 Claims, 2 Drawing Sheets

HAND HELD GRENADE LAUNCHER

This is a continuation of copending application Ser. No. 07/811,716, filed on Dec. 20, 1991, now abandoned.

BACKGROUND OF THE INVENTION

1. Field of the Invention

The present invention relates to grenade launchers and, more particularly, to a system and method to convert a rifle mountable grenade launcher into a hand held stand alone grenade launcher.

2. Prior Art

The M79 grenade launcher rifle was the first weapon to come into service which was specifically designed to fire spin stabilized grenades (40 mm). Soon after, in 1969, the M203 grenade launcher was adopted as the successor to the M79. This design utilized the capabilities of the M79 in a compact unit that attached under the grip area of the M16 service rifle. The M203 has been generally replacing the M79 on a one for one basis. However, there is still a current need for a stand alone grenade launcher rifle. As time goes by, locating replacement parts for the M79 is becoming exceedingly difficult. Because of this, long term service life of the current inventory of the M79 grenade launchers cannot be guaranteed.

U.S. Pat. No. 3,279,114 to Lewis et al. discloses a grenade launcher that is mountable to the underside of a rifle at its barrel. The launcher has a rear mount of generally U-shaped cross-section with an open top slot. U.S. Pat. No. 3,507,067 to Into discloses a similar rifle mounted grenade launcher.

Another rifle mountable grenade launcher, the M203, is also known in the prior art. Hand held stand alone grenade launchers are also known in the prior art including the M79 grenade launcher. Steyr Defence Products of Austria sells M203 type grenade launchers having a folding stock pistol unit without a rifle. U.S. Pat. No. 4,733,489 to Kurak discloses a method and apparatus for reconfiguring an automatic rifle for quick attachment and detachment of a grenade launcher.

The present invention is in regard to an adapter system that when attached to an unmodified M203 launcher converts it into a stand alone shoulder fired or hand held pistol fired grenade launcher. It is an objective of the present invention to provide a new and improved attachment for a rifle mountable grenade launcher unit to use the grenade launcher unit as a hand held stand alone grenade launcher.

SUMMARY OF THE INVENTION

The foregoing problems are overcome and other advantages are provided by a new and improved system and method to convert a rifle mountable grenade launcher into a hand held stand alone grenade launcher.

In accordance with one embodiment of the present invention, a grenade launcher is provided comprising a receiver adapter, a launcher unit, and means for fixedly attaching the launcher unit to the receiver adapter. The receiver adapter has a recoil surface and an aperture for receiving an adapter rod. The launcher unit has a frame, a trigger assembly, and a barrel. A portion of the frame is located adjacent the recoil surface of the receiver adapter. The means for fixedly attaching can attach the launcher unit to the receiver adapter and comprises an adapter rod located in both the receiver adapter aperture and a portion of the launcher unit frame.

In accordance with another embodiment of the present invention, a system for converting a rifle mountable grenade launcher into a stand alone grenade launcher is provided comprising a receiver adapter, an adapter rod, and a locking screw. The receiver adapter has a recoil surface. The adapter rod extends from the receiver adapter. The locking screw is positionable, at least partially, in a locking screw hole in the adapter rod, spaced from the receiver adapter, whereby the adapter rod can be placed into a portion of the grenade launcher unit and the locking screw attached to the rod to sandwich a portion of the grenade launcher unit between the receiver adapter and the locking screw.

In accordance with one method of the present invention, a method of assembling a grenade launcher is provided comprising providing a grenade launcher unit having a frame, a barrel, and a firing mechanism, the frame having a mounting hole adapted to mount the frame to a barrel of a rifle; inserting a rod section of an adapter into the mounting hole of the grenade launcher unit, the rod section having an aperture therein; and inserting a fastening member into the rod section aperture to fixedly mount the grenade launcher unit with the adapter.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
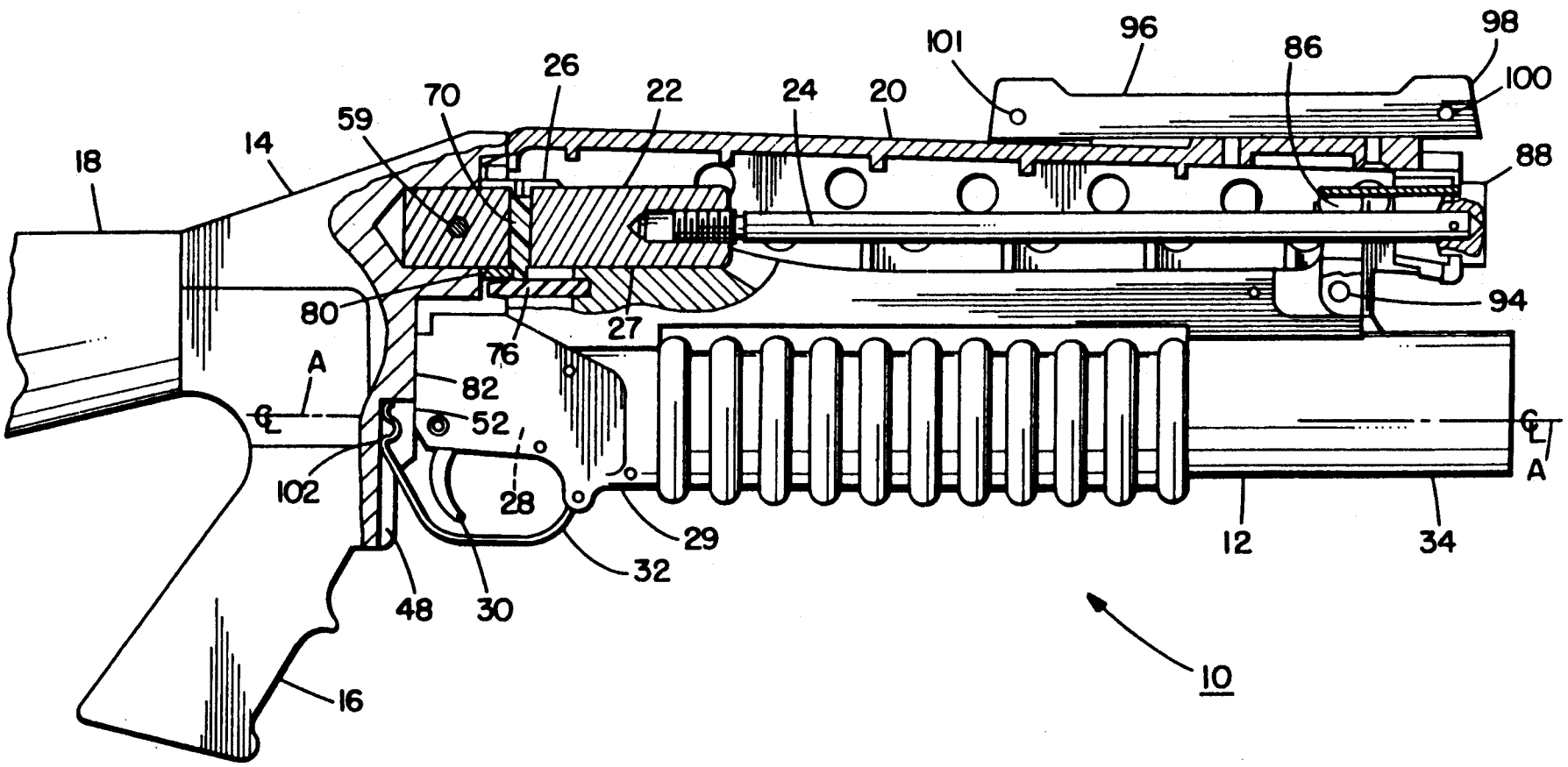
FIG. 1 is a side view of a grenade launcher incorporating features of the present invention shown with a partial cross-sectional view.

Referring to FIG. 1, there is shown a side view of a grenade launcher 10 incorporating features of the present invention with a partial sectional view. Although the present invention will be described with reference to the single embodiment shown in the drawings, it should be understood that the present invention can be incorporated into different types of embodiments. In addition, any suitable size, shape and type of elements or materials could be used.

The grenade launcher 10 generally comprises a grenade launcher unit 12, a receiver adapter 14, a pistol grip 16, a buttstock 18, a handguard 20, and connecting rods 22 and 24. However, the buttstock 18 need not be provided. The grenade launcher unit 12 is known in the prior art under the military designation M203. The unit 12 was originally designed to be mounted to an M16 rifle. The unit 12 has a frame which includes a mounting 26 with a channel 27 therethrough originally designed to receive a portion of the barrel of the M16 rifle. The unit 12 further includes a firing mechanism 28 inside a firing mechanism housing 29 with a trigger 30, a trigger guard 32, and a barrel 34. The barrel 34 can be moved forward relative to the housing 29 for loading, unloading, and ejecting spent grenade casings. The handguard 20 is also known in the prior art used with M203 grenade launcher. In addition, the buttstock 18 and pistol grip 16 are similar to those used with the M16 rifle and are generally known in the art. However, any suitable type of pistol grip or buttstock could be provided including a pistol grip and/or buttstock that is integrally formed with the adapter 14.

Figure 2:
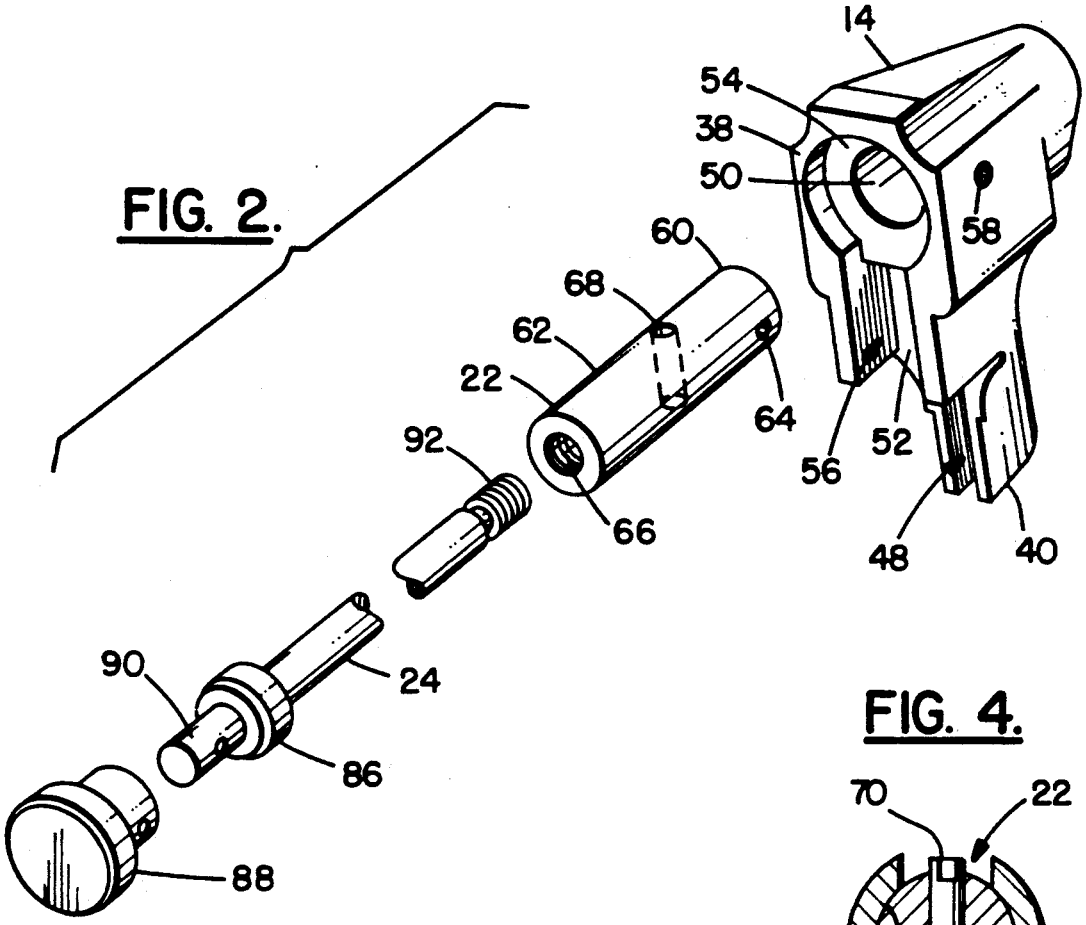
FIG. 2 is an exploded perspective view of components of the grenade launcher shown in FIG. 1.
Figure 4:
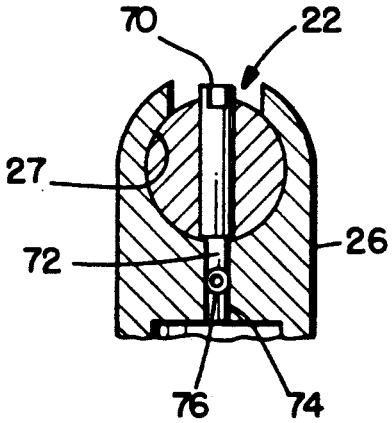
FIG. 4 is a cross-sectional view of the grenade launcher unit's mounting and showing the positions of the adapter rod, locking screw, and roll pin of the embodiment shown in FIG. 1.
Figure 3:
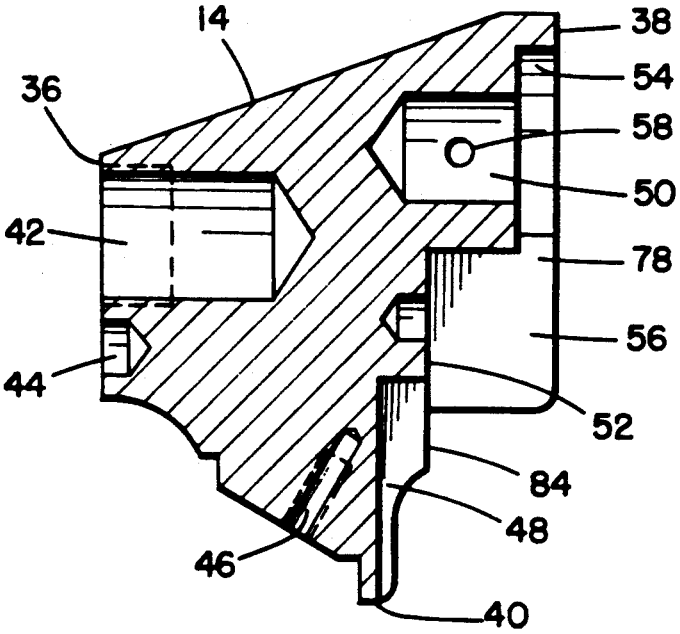
FIG. 3 is a cross-sectional view of the receiver adapter of the grenade launcher shown in FIG. 1.

Referring now also to FIGS. 2–4, the receiver adapter 14 is generally comprised of a suitable material such as metal or plastic. The adapter 14 has a rear end 36, a front end 38, and a bottom section 40. The rear end 36 has two holes 42 and 44 for connecting the buttstock 18 to the rear end 36. The bottom section 40 has a threaded hole 46 for attaching the pistol grip 16 to the adapter 14, and a slot 48 adapted to receive a rear end of the trigger guard 32. The front end 38 of the adapter 14 generally comprises an adapter rod hole 50, a recoil surface 52, a handguard recess 54, and a slot 56 for a portion of the grenade launcher unit frame. The adapter 14 also has a hole 58 extending from the adapter rod hole 50 to an exterior side of the adapter 14. The hole 58 is provided for a pin 59 to fixedly mount the adaptor rod 22 to the adapter 14.

The adapter rod 22 is preferably made of metal and has a general rod shape. The adapter rod 22 has a first end 60 and a second end 62. The first end 60 is located in the adapter hole 50 and has a pin hole 64 for receiving a portion of pin 59. The pin 59 is press-fit into the holes 58 and 64 to interlock the adapter rod with the adapter. However, any suitable type of means to mount the rod 22 to the adapter 14 could be provided. In an alternate embodiment, the adapter rod 22 may be integrally formed with the adapter 14. The second end 62 of the adapter rod 22 includes an axial hole 66 which is threaded to fixedly, but removably connect the handguard rod 24 with the adapter rod 22. However, any suitable means of connecting the handguard rod 24 to the adapter rod 22 could be provided. In an alternate embodiment, the handguard rod 24 may be integrally formed with the adapter rod 22. In the embodiment shown, located between and transverse to the holes 64 and 66 is a a locking screw hole 68 that is threaded and extends entirely through the adapter rod 22. The locking screw hole 68 has a locking screw 70 located therein for fixedly attaching the mounting 26 of the grenade launcher unit 12 with the adapter rod 22. As can be seen in FIG. 4, the top of the mounting 26 is open such that the adapter rod 22 and mounting 26 can first be positioned relative to each other and then the locking screw 70 connected to the adapter rod 22. The length of the screw 70 is larger than the diameter of the adapter rod 22. Thus, the bottom 72 of the locking screw 70 is able to extend past the bottom of the adapter rod 22. The mounting 26 has a slot 74 at the bottom of channel 27 for receiving the bottom 72 of the locking screw 70. Also located in the slot 74 is a roll pin 76 which has a general "C" shaped cross-section. The roll pin 76 is mounted to the mounting 26 and acts as a stop surface to stop the leading edge of the locking screw 70. The leading edge of the locking screw is advanced until it is stopped by the roll pin 76. Compression of the roll pin 76 by the locking screw 70 provides a locking torque to the locking screw to prevent it from backing out. As can be seen in FIG. 1, a portion 80 of the mounting 26 is located between the bottom 72 of locking screw 70 and the adapter 14. This arrangement prevents the mounting 26 from axially longitudinally sliding on the adapter rod 22. Thus, the mounting 26 and adapter rod 22 are effectively locked together. The rear end of the frame is also located in slot 56. This prevents the grenade launcher unit 12 from axially rotating about the adapter rod 22. Thus, the unit 12 is stationarily fixed to the adapter 14.

With the mounting 26 locked to the adapter rod 22 a rear surface 82 of the frame of the grenade launcher unit 12 is located adjacent the recoil surface 52. In the embodiment shown, the recoil surface includes areas 84. The grenade launcher unit 12 has a barrel bore center axis A that intersects the recoil surface 52 and, the rear surface 82 makes contact with recoil surface 52 at this intersection such that an axis of recoil is provided approximate to the barrel bore axis. This minimizes moment forces between the adapter 14 and grenade launcher unit 12 when fired. Thus, less muzzle climb or flip occurs when fired. However, in an alternate embodiment, the center axis A need not intersect the recoil surface 52. An area of the barrel bore may be partially aligned in front of the recoil surface 52, or the barrel bore may be totally offset from alignment with the recoil surface.

The handguard 20 is connected to the adapter 14 by use of the handguard rod 24 which has a guide bushing 86 thereon, an end cap 88 mounted to a first end 90 of the rod 24, and a second end that has threads. The end cap 88 is fixed to the first end 90 by means of a pin (not shown). The second end 92 can be screwed into and out of the adapter rod front hole 66 by rotating the end cap 88 which rotates the handguards rod 24. The guide bushing 86 is captured by the standard M203 front mounting bracket 94 to control vertical orientation of the handguard assembly. A sight assembly 96 has been provided that uses a flip up front sight blade in conjunction with the standard M203 flip up rear sight leaf within the single common sight base 98 of the assembly 96. The blades are not seen in FIG. 1 because they are located in a down position, but they pivotally move at pins 100 and 101. The sight assembly 96 is fixedly mounted to the top front of the handguard 20. The handguard 20 has a rear tapered portion that is received in adapter recess 54. The handguard rod assembly is then screwed into the adapter rod 22. The front end of the handguard 20 is contacted by the handguard rod assembly to apply a locking screw force on the front of the handguard 20 and thereby fixedly, but removably lock the handguard 20 to the adapter 14 and grenade launcher unit 12.

The rear end 102 of the trigger guard 32 is captured within a area or slot 48 in the adapter 14 and is held in place by friction and a mechanical advantage caused by its being slightly compressed and the location of its pivotal connection to frame. The trigger guard 32 is capable of being placed in the open position by applying sufficient downward force to overcome the mechanical advantage and friction of slot 48 for purposes such as when the user is wearing gloves on his hand that otherwise would prevent the user from positioning a finger in front of the trigger 30.

As can be seen from the above description, the present invention has various characteristics. The method of attaching the adapter and M203 grenade launcher unit is significantly different from previous grenade launcher designs. The adapter mounting method of mounting the adapter 14 with the grenade launcher unit 12 does not require the use of the M203 front mounting threads. The front mounting threads are merely used, in the embodiment shown, for connecting the handguard 20 to the unit 12. Therefore, if the threaded holes are not used on the handguard 20, such as when the handguard is not provided or a different type of handguard is provided, these threaded holes can be utilized for mounting other accessories. The M203 unit is not modified and may be readily detached from the adapter and attached to an M16 rifle. The size and weight the present design is very close to the M79, thereby providing similar handling characteristics. The system recoil is absorbed in line with the barrel bore. Therefore, muzzle climb is minimized. The present design can replace the M79 and, because it utilizes M203 grenade launcher units, parts are readily available.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A grenade launcher comprising:
- a receiver adapter having a front recoil surface, an aperture located above the recoil surface, and means for connecting a pistol grip to the receiver adapter;
- a launcher unit having a frame, a trigger assembly and a barrel, a portion of the frame being located adjacent the recoil surface of the receiver adapter and in front of the aperture;
- means for fixedly attaching the launcher unit to the receiver adapter comprising an adapter rod located in both the aperture of the receiver adapter and the portion of the launcher unit frame; and
- a handguard connected to the adapter rod by a handguard rod to retain the handguard with the receiver adapter.

2. A grenade launcher as in claim 1 wherein the receiver adapter includes means for attaching a buttstock thereto.

3. A grenade launcher as in claim 1 further comprising means for fixedly connecting the adapter rod to the receiver adapter.

4. A grenade launcher as in claim 1 wherein the means for fixedly attaching the launcher unit to the receiver adapter further includes a locking screw positioned in a locking screw hole of the adapter rod and extending into a portion of the launcher unit frame.

5. A grenade launcher as in claim 1 wherein the handguard having a sight assembly connected thereto.

6. A grenade launcher as in claim 1 wherein the receiver adapter includes a trigger guard slot for receiving a rear end of a trigger guard of the launcher unit.

7. A grenade launcher as in claim 1 wherein the recoil surface is located below the adapter rod and the barrel has a center axis that intersects the recoil surface.

8. A grenade launcher comprising:
- a buttstock;
- a receiver adapter connected to the buttstock, the receiver adapter having a front recoil surface and a front aperture located above the recoil surface;
- an adapter rod positioned in and extending from the aperture;
- a launcher unit located adjacent the front recoil surface, the adapter rod extending into a portion of the launcher unit; and
- means for stationarily connecting the launcher unit to the receiver adapter comprising a locking screw that extends through the adapter rod to a position behind a portion of the launcher unit.

9. A grenade launcher as in claim 8 wherein the launcher unit further includes a handguard having a sight assembly connected thereto.

10. A grenade launcher as in claim 9 further comprising a handguard rod connected to the adapter rod to retain the handguard with the receiver adapter.

11. A grenade launcher as in claim 8 wherein the receiver adapter includes a trigger guard slot for receiving a rear end of a trigger guard of the launcher unit.

12. A grenade launcher as in claim 8 wherein the recoil surface is located below the adapter rod and a barrel of the launcher unit has a center axis that intersects the recoil surface.

13. A grenade launcher comprising:
- a pistol grip;
- a receiver adapter connected to the pistol grip, the receiver adapter having a front recoil surface and a rod section extending in a forward direction above the recoil surface;
- a launcher unit having a frame, a trigger assembly and a barrel, a portion of the frame being located adjacent the front recoil surface and the rod section extending into a portion of the frame; and
- means for fixedly connecting the launcher unit to the receiver adapter comprising a locking member that extends from the adapter rod to a position behind a portion of the launcher unit.

* * * * *